US008485149B2

(12) United States Patent
Kim

(10) Patent No.: US 8,485,149 B2
(45) Date of Patent: Jul. 16, 2013

(54) CONTINUOUS VARIABLE VALVE LIFT APPARATUS

(75) Inventor: Jang Heon Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 357 days.

(21) Appl. No.: 12/950,322

(22) Filed: Nov. 19, 2010

(65) Prior Publication Data

US 2011/0315103 A1 Dec. 29, 2011

(30) Foreign Application Priority Data

Jun. 25, 2010 (KR) ..... 10-2010-0060764

(51) Int. Cl.
*F01L 1/34* (2006.01)

(52) U.S. Cl.
USPC ..... 123/90.16; 123/90.15; 123/90.39

(58) Field of Classification Search
USPC ..... 123/90.15, 90.16, 90.39
See application file for complete search history.

(56) References Cited

U.S. PATENT DOCUMENTS 7,322,324 B2 * 1/2008 Hara et al. ..... 123/90.16

FOREIGN PATENT DOCUMENTS

JP 2007040291 A 2/2007
KR 1020090013353 A 2/2009

* cited by examiner

*Primary Examiner* — Zelalem Eshete
(74) *Attorney, Agent, or Firm* — Morgan, Lewis & Bockius LLP

(57) ABSTRACT

A continuously variable valve lift apparatus includes a camshaft, a first cam disposed on the camshaft, a first valve opening/closing unit, a control unit transferring rotation of the first cam to the first valve opening/closing unit and adjusting valve lift of the first valve opening/closing unit, a second cam disposed on the camshaft and a second valve opening/closing unit constantly opened and closed by rotation of the second cam.

8 Claims, 5 Drawing Sheets

(a)

(b)

CONTINUOUS VARIABLE VALVE LIFT APPARATUS

CROSS-REFERENCE TO RELATED APPLICATION

This application claims priority to and the benefit of Korean Patent Application No. 10-2010-0060764 filed in the Korean Intellectual Property Office on Jun. 25, 2010, the entire contents of which application is incorporated herein for all purposes by this reference.

BACKGROUND OF THE INVENTION

1. Field of the Invention

The present invention relates to a valve lift apparatus. More particularly, the present invention relates to a continuously variable valve lift apparatus which may adjust valve lift asymmetrically.

2. Description of the Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches, such as designing of a plurality of cam and a variable valve lift (VVL) that can change valve lift according to engine speed, have been undertaken.

However, in a conventional variable valve lift apparatus, air inflowing amount is not sufficient in a low lift state, so that engine performance may be deteriorated.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

Various aspects of the present invention have been made in an effort to provide a continuously variable valve lift apparatus having advantages of improving air and/or air-fuel intake efficiency by generating vortex in low and high load of an engine with constant valve lift and continuous valve lift together.

With a scheme that adjusts just one valve, manufacturing cost may be reduced.

A continuously variable valve lift apparatus according to various aspects of the present invention may include a camshaft, a first cam disposed on the camshaft, a first valve opening/closing unit, a control unit transferring rotation of the first cam to the first valve opening/closing unit and adjusting valve lift of the first valve opening/closing unit, a second cam disposed on the camshaft and a second valve opening/closing unit constantly opened and closed by rotation of the second cam.

The control unit may include a control cam which includes a contact portion contacting the first cam and pivots around a pivot shaft, and of which a driving portion, contacting the first valve opening/closing unit, is formed thereon, and a control unit which adjust positions of the pivot shaft for adjusting relative contacting position of the driving portion and the first valve opening/closing unit.

The control unit may include a control shaft disposed parallel to the camshaft and a swing arm of which the pivot shaft is disposed thereon and of which one end is connected to the control shaft and the other end is rotatably connected to an engine, wherein relative positions of the pivot shaft may be changed according to rotation of the control shaft.

The control unit may further include an actuating lever which is connected the control shaft and of which a sliding portion is formed thereon, wherein the swing arm may be connected to the actuating lever via a control pin which is inserted into the sliding portion and slides along the sliding portion according to rotation of the control shaft.

The sliding portion may be formed as an ellipse shape and one end of the sliding potion is closer than the other end of the sliding potion.

The apparatus may further include a first cam roller for reducing friction between the contact portion and the first cam.

A continuously variable valve lift apparatus according to various aspects of the present invention may include a camshaft, a first cam disposed on the camshaft, a first valve opening/closing unit, a control cam which includes a contact portion contacting the first cam and pivots around a pivot shaft, and of which a driving portion, contacting the first valve opening/closing unit, is formed thereon, a control shaft disposed parallel to the camshaft, a swing arm of which the pivot shaft is disposed thereon and of which one end is connected to the control shaft and the other end is rotatably connected to an engine, a second cam disposed on the camshaft, and a second valve opening/closing unit constantly opened and closed by rotation of the second cam.

The control unit may further include an actuating lever which is connected the control shaft and of which a sliding portion is formed thereon, wherein the swing arm may be connected to the actuating lever via a control pin which is inserted into the sliding portion and slides along the sliding portion according to rotation of the control shaft.

The sliding portion may be formed as an ellipse shape and one end of the sliding potion is closer than the other end of the sliding potion.

As described above, the continuously variable valve lift apparatus according to various aspects of the present invention may improve air and/or air-fuel intake efficiency by generating vortex in low and high load of an engine with constant valve lift and continuous valve lift together.

And also, the continuously variable valve lift apparatus according to various aspects of the present invention may reduce manufacturing cost with a scheme that adjusts just one valve.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION

Figure 1:
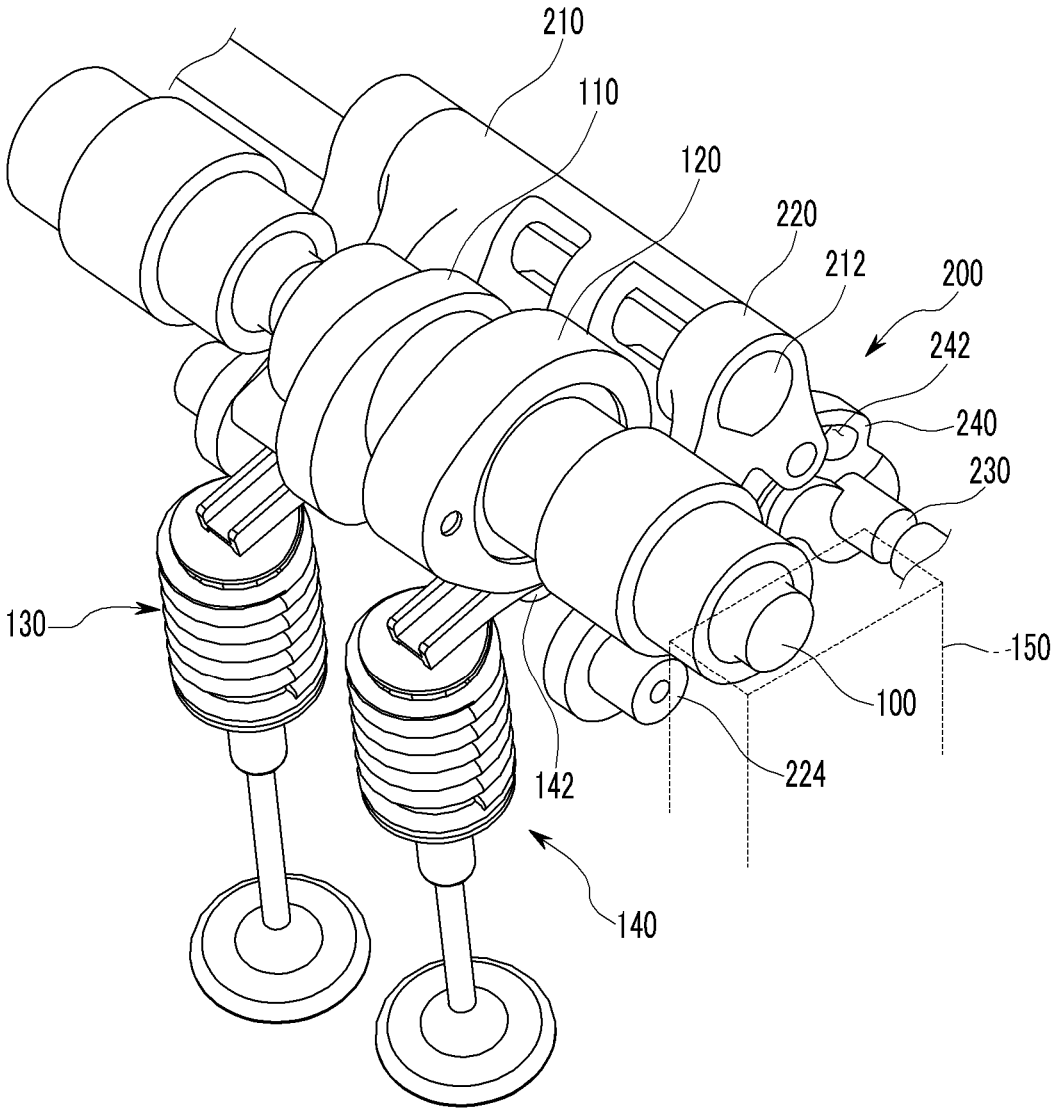
FIG. 1 is a perspective view of an exemplary continuously variable valve lift apparatus according to the present invention.
Figure 2:
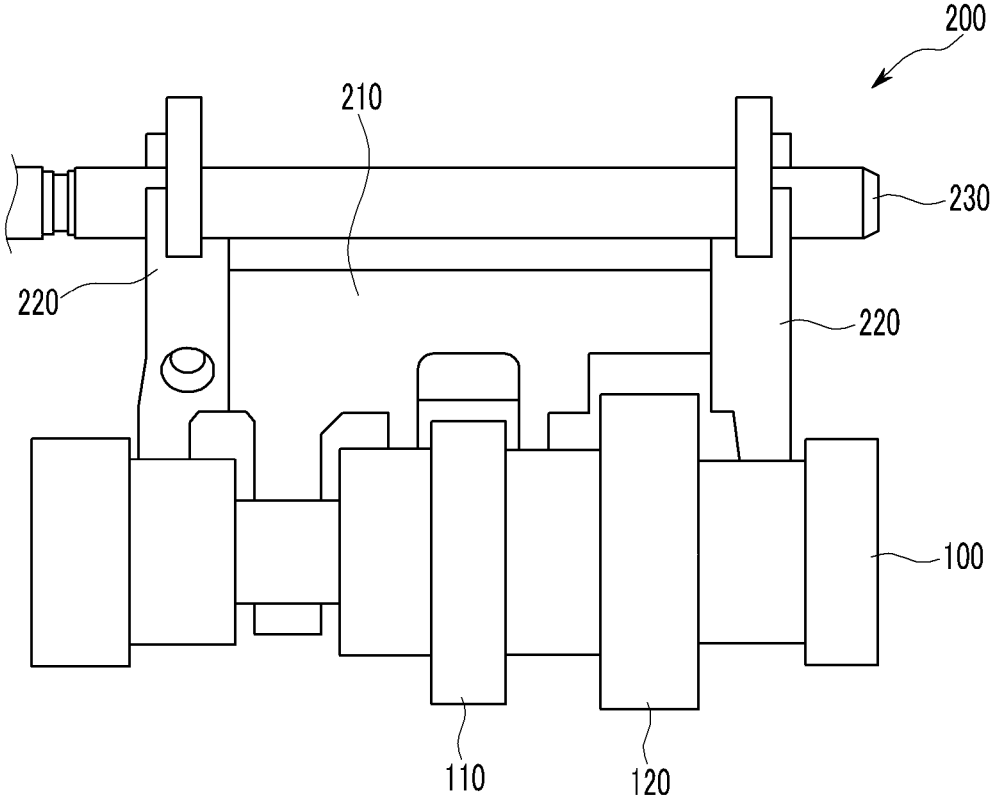
FIG. 2 is a top plan view of an exemplary continuously variable valve lift apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Referring to FIG. 1 to FIG. 5, a continuously variable valve lift apparatus according to various embodiments of the present invention may include a camshaft 100, a first cam 110 disposed on the camshaft 100, a first valve opening/closing unit 130, a control unit 200 transferring rotation of the first cam 110 to the first valve opening/closing unit 130 and adjusting valve lift of the first valve opening/closing unit 130, a second cam 120 disposed on the camshaft 100 and a second valve opening/closing unit 140 constantly opened and closed by rotation of the second cam 120.

In the drawing, although the second valve opening/closing unit 140 is a swing arm type opening/closing unit including a roller 142, however the invention is not limited the illustrated embodiments, for example a valve opening/closing unit may include a tappet type realizing constant valve lift. That is, the second valve opening/closing unit 140 and the second cam 120 may be a valve opening/closing unit that is used in conventional valve train, and the first cam 110 and the first valve opening/closing unit 130 are provided with the control unit 200 so as to adjust valve lift of the first valve opening/closing unit 130.

The control unit 200 includes a control cam 210 which includes a contact portion 214 contacting the first cam 110 and pivots around a pivot shaft 212, and of which a driving portion 216, contacting the first valve opening/closing unit 130, is formed thereon, and a control unit which adjust positions of the pivot shaft 212 for adjusting relative contacting position of the driving portion 216 and the first valve opening/closing unit 130.

The contact portion 214 is provided with a first cam roller 214 to reduce friction between the contact portion 214 and the first cam 110.

The control unit includes a control shaft 230 disposed parallel to the camshaft 100 and a swing arm 220 of which the pivot shaft 212 is disposed thereon and of which one end 222 is connected to the control shaft 230 and the other end 224 is rotatably connected to an engine 150, wherein relative positions of the pivot shaft 212 is changed according to rotation of the control shaft 230.

The control unit further includes an actuating lever 240 which is connected the control shaft 230 and of which a sliding portion 242 is formed thereon, wherein the swing arm 220 is connected to the actuating lever 240 via a control pin 222 which is inserted into the sliding portion 242 and slides along the sliding portion 242 according to rotation of the control shaft 230. Herein, the one end 222 of the swing arm 220 may be the control pin 222 and the other end 242 of the swing arm 220 may be a connecting pin 224.

The sliding portion 242 is formed as an ellipse shape and one end of the sliding potion 242 is closer than the other end of the sliding potion 242.

Figure 5:
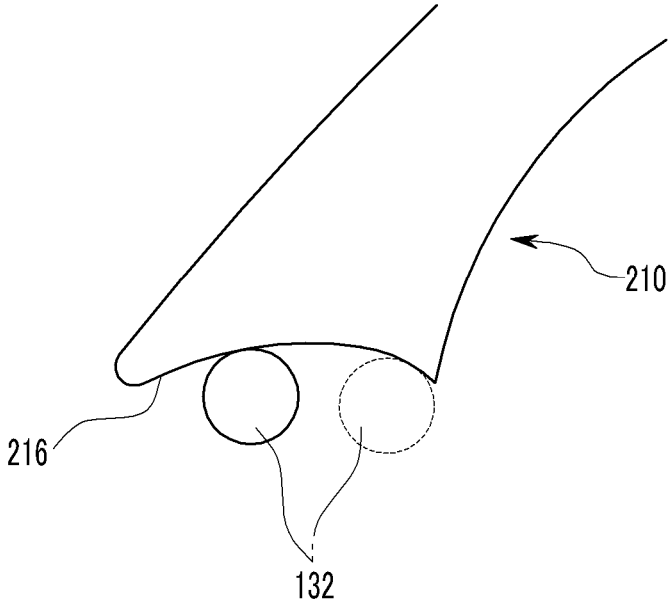
FIG. 5 is a drawing showing a driving portion of a control cam of an exemplary continuously variable valve lift apparatus according to the present invention.
Figure 5:
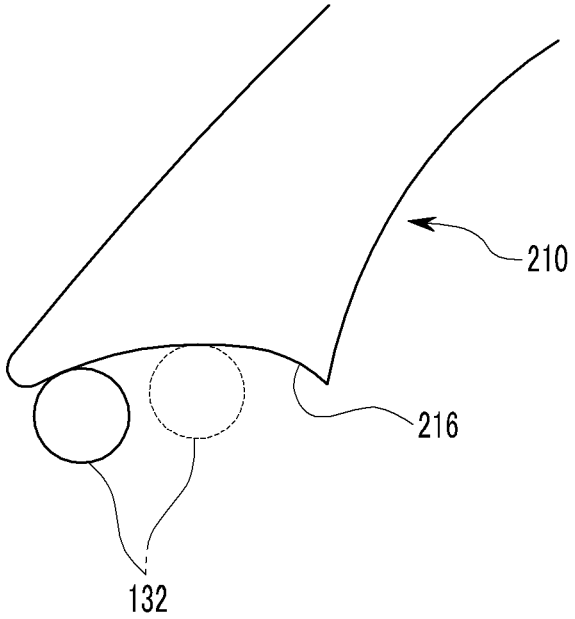

Referring to FIG. 5, the first valve opening/closing unit 130 is provided with a first valve opening/closing unit roller 132, the first valve opening/closing unit roller 132 contacts the driving portion 216, and thus the first valve opening/closing unit 130 is opened and closed.

Figure 4:
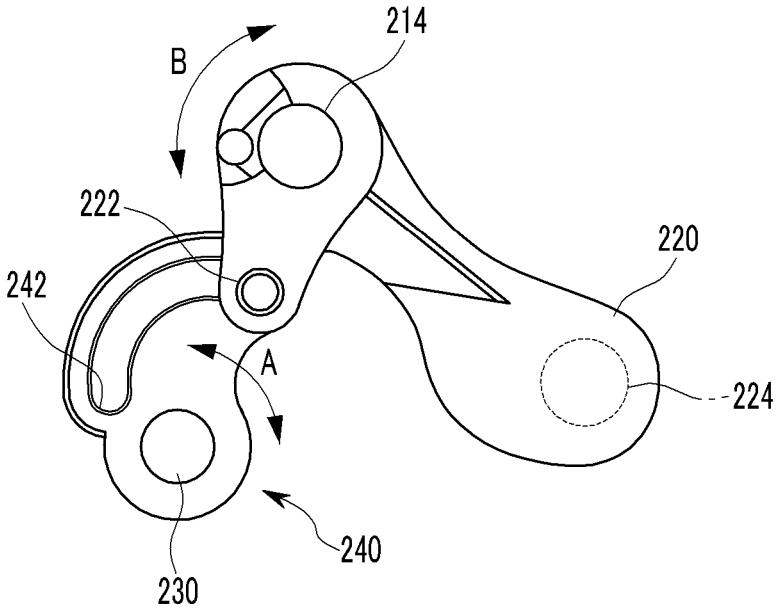
FIG. 4 is a drawing showing a swing arm and an actuating lever of an exemplary continuously variable valve lift apparatus according to the present invention.

Referring to FIG. 1 and FIG. 4, the end 222 of the swing arm 220 is the control pin 222 connected to the control shaft 230 via the sliding portion 242, and the other end 224 of the swing arm 220 is connected the engine 150, wherein the engine 150 may be defined including a cylinder head, a cam carrier and so on of which the swing arm 220 is rotatably connected to.

Hereinafter, referring to FIG. 1 to FIG. 5, operations of the continuously variable valve lift apparatus according to various embodiments of the present invention will be explained.

Referring FIG. 4 and (a) of FIG. 5, a high lift mode of the continuously variable valve lift apparatus according to various embodiments of the present invention is shown.

When low valve lift is required according to an engine operation, an ECU (engine control unit) controls an actuator or a control motor (not shown) to rotate the control shaft 230 to anticlockwise direction of FIG. 4.

Operations and so on of the ECU, the actuator or the control motor are obvious to a person skilled in the art so that detailed explanation will be omitted.

And then the actuating lever 240 connected to the control shaft 230 rotates to anticlockwise direction, and the control pin 222 moves along the sliding portion 242.

The sliding portion 242 is formed as an ellipse shape for the swing arm 220 for the connecting pin 224 to rotate around the connecting pin.

And thus, the swing arm 220 rotates to anticlockwise direction around the connecting pin 224 according to rotation of the actuating lever 240.

Figure 3:
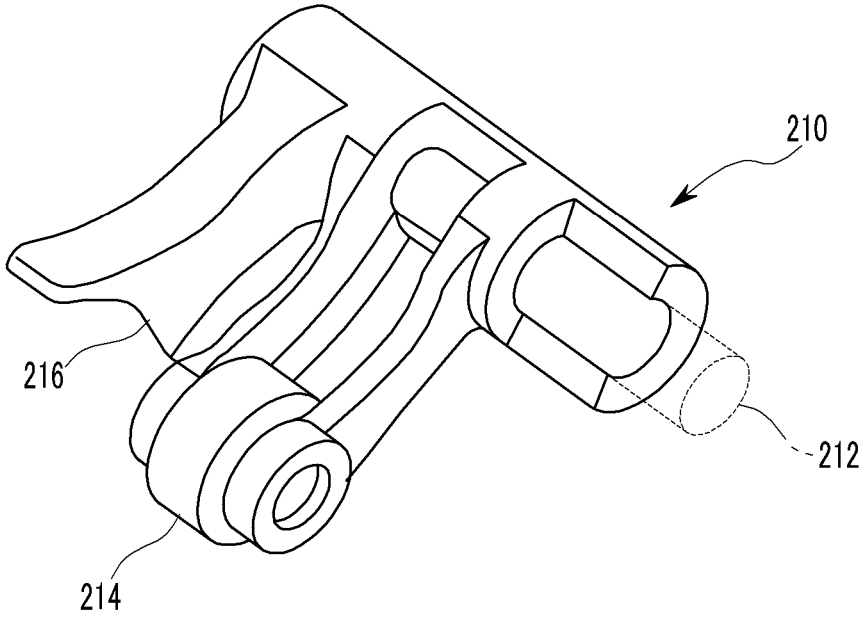
FIG. 3 is a perspective view of a control cam of an exemplary continuously variable valve lift apparatus according to the present invention.

The pivot shaft 212 shown in FIG. 1 and FIG. 3 moves for relative contact position between first valve opening/closing unit roller 132 and the driving portion 216 to be moved.

That is, when engine operation condition is changed from a high lift mode ((a) of FIG. 5) to a low lift mode ((b) of FIG. 5), the relative contact position between first valve opening/closing unit roller 132 and the driving portion 216 moves left side of the FIG. 5.

As shown in (b) of FIG. 5, in the low lift mode, relative contacting position of the driving portion 216 is changed so that valve lift relatively reduced.

When high valve lift is required, the control shaft 230 rotates to clockwise direction and also the swing arm 220 rotates to clockwise direction of FIG. 4.

And then, relative contact position between the first valve opening/closing unit roller 132 and the driving portion 216 moves as shown in (a) of FIG. 5, and thus valve lift relatively is increased.

Although operations of the high and low lift mode are described, the continuous variable valve lift apparatus of the present invention may realize continuous valve lift change, and repeated explanation will be omitted.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:
a camshaft;
a first cam disposed on the camshaft;
a first valve opening/closing unit;
a control unit transferring rotation of the first cam to the first valve opening/closing unit and adjusting valve lift of the first valve opening/closing unit;
a second cam disposed on the camshaft; and
a second valve opening/closing unit constantly opened and closed by rotation of the second cam;
wherein the control unit comprises:
a control cam which includes a contact portion contacting the first cam and pivots around a pivot shaft, and of which a driving portion, contacting the first valve opening/closing unit, is formed thereon; and
a control unit which adjust positions of the pivot shaft for adjusting relative contacting position of the driving portion and the first valve opening/closing unit.

2. The apparatus of claim 1, wherein the control unit comprises;
a control shaft disposed parallel to the camshaft; and
a swing arm of which the pivot shaft is disposed thereon and of which one end is connected to the control shaft and the other end is rotatably connected to an engine,
wherein relative positions of the pivot shaft is changed according to rotation of the control shaft.

3. The apparatus of claim 2, wherein the control unit further comprises an actuating lever which is connected the control shaft and of which a sliding portion is formed thereon,
wherein the swing arm is connected to the actuating lever via a control pin which is inserted into the sliding portion and slides along the sliding portion according to rotation of the control shaft.

4. The apparatus of claim 3, wherein the sliding portion is formed as an ellipse shape and one end of the sliding portion is closer than the other end of the sliding portion.

5. The apparatus of claim 1, wherein the apparatus further comprises a first cam roller for reducing friction between the contact portion and the first cam.

6. A continuously variable valve lift apparatus comprising:
a camshaft;
a first cam disposed on the camshaft;
a first valve opening/closing unit;
a control cam which includes a contact portion contacting the first cam and pivots around a pivot shaft, and of which a driving portion contacting the first valve opening/closing unit is formed thereon;
a control shaft disposed parallel to the camshaft;
a swing arm of which the pivot shaft is disposed thereon and of which one end is connected to the control shaft and the other end is rotatably connected to an engine;
a second cam disposed on the camshaft; and
a second valve opening/closing unit constantly opened and closed by rotation of the second cam.

7. The apparatus of claim 6, the control unit further comprises an actuating lever which is connected the control shaft and of which a sliding portion is formed thereon,
wherein the swing arm is connected to the actuating lever via a control pin which is inserted into the sliding portion and slides along the sliding portion according to rotation of the control shaft.

8. The apparatus of claim 7, wherein the sliding portion is formed as an ellipse shape and one end of the sliding portion is closer than the other end of the sliding portion.

* * * * *